US006164765A

United States Patent [19]

Sato et al.

[11] Patent Number: 6,164,765

[45] **Date of Patent: *Dec. 26, 2000**

[54] INK REFILLING CONTAINER AND INK REFILLING METHOD USING SAME

[75] Inventors: Osamu Sato, Kawasaki; Hiroshi Sugitani, Machida, both of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/174,442

[22] Filed: Dec. 28, 1993

[30] Foreign Application Priority Data

Jan. 1, 1993 [JP] Japan ..... 5-015084
Dec. 15, 1993 [JP] Japan ..... 5-314793

[51] Int. Cl.[7] ..... B41J 2/175

[52] U.S. Cl. ..... 347/85; 347/86

[58] Field of Search ..... 347/85, 86, 87; 346/140.1

[56] References Cited

U.S. PATENT DOCUMENTS

| | | | |
|---|---|---|---|
| 3,482,258 | 12/1969 | Steen | 346/140.1 |
| 3,522,607 | 8/1970 | Felton | 346/140.1 |
| 3,967,286 | 6/1976 | Andersson et al. | 347/85 |
| 4,931,814 | 6/1990 | Yoshimura | 346/140 |
| 4,967,207 | 10/1990 | Ruder | 346/140 R |
| 4,968,998 | 11/1990 | Allen | 346/140 R |
| 5,136,305 | 8/1992 | Ims | 347/85 |
| 5,162,817 | 11/1992 | Tajika et al. | 347/85 |
| 5,182,579 | 1/1993 | Haruta et al. | 347/87 |
| 5,199,470 | 4/1993 | Goldman | 141/1 |
| 5,329,294 | 7/1994 | Ontawar et al. | 397/87 |
| 5,510,820 | 4/1996 | Aulick et al. | 347/85 |

FOREIGN PATENT DOCUMENTS

| | | | |
|---|---|---|---|
| 0378240 | 7/1990 | European Pat. Off. . | |
| 378290 | 7/1990 | European Pat. Off. | 347/86 |
| 0509747 | 10/1992 | European Pat. Off. . | |
| 0546544 | 6/1993 | European Pat. Off. . | |
| 0567308 | 10/1993 | European Pat. Off. . | |
| 60-204353 | 10/1985 | Japan . | |
| 63-9545 | 1/1988 | Japan | 347/87 |
| 03101970 | 4/1991 | Japan . | |
| 04250068 | 9/1992 | Japan . | |

*Primary Examiner*—John Barlow
*Assistant Examiner*—Helen Mahoney
*Attorney, Agent, or Firm*—Fitzpatrick, Cella, Harper & Scinto

[57] ABSTRACT

An ink refilling container includes an ink containing portion for containing ink to refill, an ink injection tube for connection with the ink containing portion, an air vent, provided in the ink container, for communication with ambience, and an openable member for closing the air vent. A meniscus of ink is formed adjacent an end of the injection tube, and the ink is not leaked externally when the air vent is closed.

21 Claims, 8 Drawing Sheets

INK REFILLING CONTAINER AND INK REFILLING METHOD USING SAME

FIELD OF THE INVENTION AND RELATED ART

The present invention relates to an ink refilling container for refilling an ink container with ink and ink refilling method using the ink refilling container. More particularly it relates to the ink refilling container for refilling with the ink an ink containing portion of an ink jet cartridge unified with a recording head to be detachably mounted on an ink jet recording apparatus, and an ink refilling method using the ink refilling container.

A widely used type of ink jet recording machine, an ink jet unit of a cartridge type having integral recording head and an ink container, the ink container containing ink in an ink absorbing material therein to supply the ink to the recording head. The ink jet recording head is detachably mountable on a carriage which scars the recording material. The ink jet unit is replaced with a fresh ink jet unit when the ink in the ink container is used up.

However, the service life of the recording head is longer than the quantity of the ink contained in the ink container in the ink jet unit, and therefore, even if the ink of the ink jet unit is used up, the recording head may still be usable. Disposing of such an ink jet unit is not preferable from the standpoint of natural resources and environmental conditions.

Accordingly, refilling of the ink container for such an ink jet unit with ink has been proposed. Graphic utilities has proposed that an injection needle of metal is mounted to an ink container in the form of bellows. An ink container is pierced, and the needle is inserted through the pierced hole, and thereafter, the bellows of the ink container is manually collapsed gradually to pressure the ink into the container. The ink container may be in the form of an injector to press the ink into the container.

In such an ink refilling system, the needle member can injure the user. If the ink is too much pressurized, the ink is discharged at a speed higher than the ink seeping speed with the result that the ink overflows through the hole. In order to refilled ink without the overflowing, the pressurized state is maintained at a predetermined condition. The mechanism for the maintenance will be complicated. Because the operators manipulation is required throughout the ink refilling period because of the necessity for maintaining the pressurized state, the operator is confined to the refilling operation for a long period of time. In the bellow type or injector type container, the flow resistance is small before the needle is inserted into the ink container, and therefore, the ink leaks out by small shock or the like. When the ink refilling device is to be disposed, the resin material constituting the ink container and the injection needle of metal, has to be separately disposed of.

The inventors have made various investigations and considerations, and the ink is refilled using spontaneous falling of the ink, by which the operator confining period is reduced, the ink overflow Is prevented. By improving the structure of the connection between the ink container and the ink refilling container, ink overflow is further prevented.

SUMMARY OF THE INVENTION

Accordingly, It is a principal object of the present invention to provide an ink refilling container and an ink refilling method using same in which the ink leakage or other problems are solved.

According to an aspect of the present invention, there is provided an ink refilling container comprising: an ink containing portion for containing ink; an ink injection tube for connection with the ink containing portion: an air vent, provided in the ink container, for communication with ambience; an openable member for closing the air vent; wherein a meniscus of ink is formed adjacent an end of the injection tube, and the ink is not leaked externally when the air vent is closed.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Referring to the accompanying drawings, the embodiments of the present invention will be described in detail.

Figure 1:
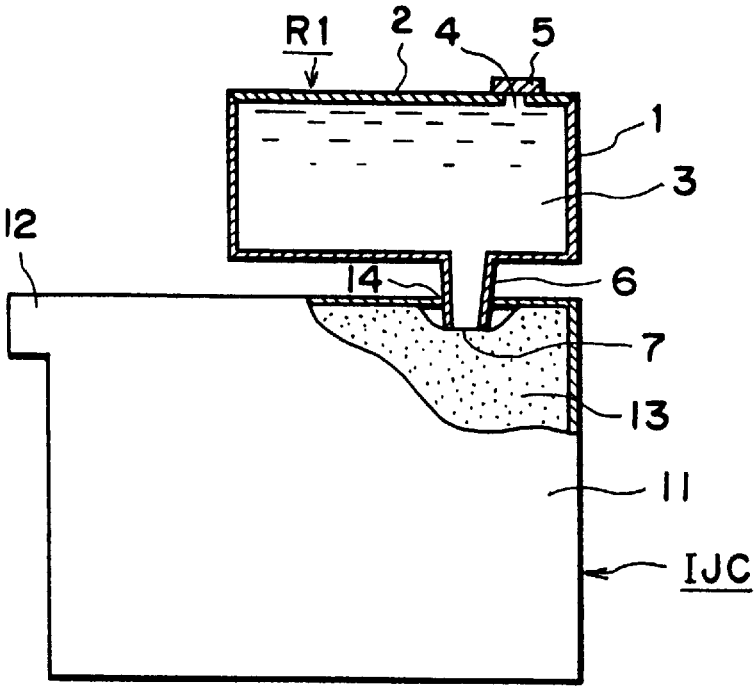
FIG. 1 is a sectional view of an example of an ink refilling system according to an embodiment of the present invention.

Referring to FIG. 1, there is shown an ink refilling container R1 and an ink container 11 for an ink jet cartridge IJC. The ink refilling container or ink refiller R1 comprises an ink containing portion 1 for containing ink 3 and a cover covering the ink container 1, an ink injection tube 6 for injecting the ink from the ink containing portion 1 to the ink container 11.

The cover 2 is provided with an air vent 4 for communication with the ambient air and the inside of the ink containing portion 1. The air vent 4 is sealed by a sealing member 5 which seals the air vent when the ink refiller R1 is not used, but the sealing member 5 is removed when the refilling operation is to be effected. The cover 2 is mounted to the ink containing portion 1 by ultrasonic welding.

The ink jet cartridge IJC comprises an ink container 11 for containing the ink, and a recording head 12 for ejecting ink supplied from the ink container. In the ink container 11, an ink absorbing material 13 is accommodated, and an air vent 14 for communication between the inside of the ink container 11 and the ambience.

In FIG. 1, the ink refiller R1 is connected with the ink jet cartridge IJC through the air vent 14. However, the communication may be established through an opening exclusively for the connection.

The injection tube 6 of the ink refiller R1 connected to the ink jet cartridge IJC is brought into press-contacted with the absorbing material 13 to permit smooth flow out of the ink from the supply port 6 at the end of the ink injection tube 6 to the inside of the ink container 11.

The ink containing portion 3 of the ink refiller R1 is made of rigid material, so that it is not easily deformed by external force. Therefore, the ink refiller R1 is easy to manipulate. On the contrary, the cover 2 is deformable by external force so as to permit the ink containing portion 1 to be pressurized.

When the ink refiller R1 is not used, the air vent 4 is closed by the sealing member 5, and therefore, the ink forms a meniscus is at the supply port 7 of the ink injection tube 6, thus preventing leakage of the ink therethrough. However, if the supply port 7 is too large, the meniscus may not be formed at the inlet port. In view of this, the supply port 7 has such a diameter that the meniscus is formed at the supply port 7 when the air vent 4 is closed, and that the meniscus not easily destroyed by an external factor such as force. The preferable diameter is determined properly by one skilled in the art depending on the material of the ink and the viscosity thereof. Generally, it is preferably 1 mm–3 mm.

With this structure, even when the ink refiller R1 is subjected to an external force or the like when the ink refilling operation is not carried out, the ink is not easily leaked out, and therefore, the reliability is improved.

When the ink injection tube 6 of the ink refiller R1 is inserted into the ink jet cartridge IJC, the sealing member 5 is removed from the air vent 6 to permit communication with the ambience. Then, the air is introduced thereinto through the air vent 4, and the meniscus formed at the supply port 7 of the ink injection tube 6 moves to be brought into contact with the absorbing material 13 in the ink container, so that the ink refilling into the ink container 11 is started. The ink fill speed into the absorbing material 13 is controlled by the ink absorbing material inherent to the absorbing material 13 because the end of the ink injection tube is in close contact with the absorbing material, and therefore, the ink does not leak out during the refilling operation.

In order to further improve the reliability, the connecting portion between the ink container 11 and the ink refiller R1 is hermetically sealed, and the air in the ink container 11 is gradually removed from a part other than the connecting portion In FIG. 1, the air is removed gradually from the recording head 12. This structure is advantageous because as the air is removed through the recording head, the ink flowing into the absorbing material is directed toward the recording heads thus permitting proper filling of the ink adjacent the recording head. It is also a preferable alternative that another connecting port other than the air vent 14 is provided to permit removal of the air through the air vent 14, without using the air vent 14 of the ink container for the connection for the ink supply.

When the meniscus is not broken at the end of the ink supply tube 6 even if the sealing member 5 is removed, the air vent 4 is closed, and the cover 2 is pushed to pressurize the inside of the ink containing portion 1 to forcedly advance the meniscus to be in contact with the absorbing material 13, thus breaking the meniscus.

The description will be made as to the refilling process. First, if the end of the ink injecting tube 6 of the ink refiller R1 is plugged for the purpose of preventing the ink leakage, the cap Is removed. Subsequently, the ink injection tube 6 is inserted into the used-up ink container 11 through the air vent 14. With this state, the ink injecting tube 6 is pressed into the ink absorbing material 13, and the ink refilling operation is not carried out.

Subsequently, in addition to the pressing force to the cover 2 of the ink refiller R1, the cover 2 is pushed toward the inside of the ink containing portion 1, by which the meniscus of the ink at the end of the ink injection tube 6 is advanced to establish communicating state between the absorbing material 13 and the ink in the ink refiller R1. Then, the sealing member 5 is removed from the air vent 4 of the cover 2 to release the inside of the ink containing portion 1 to the ambience. When the sealing member 5 is removed, the ink supply tube 6 is directed downwardly to permit spontaneous falling of the ink from the ink refiller R1, as shown in FIG. 1. Before the sealing member 5 is removed, the state of FIG. 1 may be established.

As described hereinbefore, after the communication is established between the absorbing material 13 and the ink of the ink refiller R1, the sealing member 5 is removed to open the inside of the ink containing portion 1 to the ambience, by which the ink refilling action starts by force of gravity.

According to this embodiment, the spontaneous falling of the ink is used. This will be described in further detail. The ink absorbing material in the ink container 11 is made of polyether polyurethane foam or the like is used, and therefore, when the ink is to be injected for the first time, it is required to reduce the pressure or to forcedly wet it with the ink by squeezing it within the ink, or the like. However, in the case of the refilling, the absorbing material 13 has been once wetted with the ink, and therefore, the surface of the foamed material is wet with the dye of the ink. Since the dye is easily solved in the ink solvent, it has high affinity with the fresh ink upon the refilling. Therefore, the ink spontaneously falls into the material. If the residual ink deposited on the absorbing material 13 has been dried, and therefore, the ink does not easily fall, the cover 2 of the refiller R1 is pushed, by which the ink is pressed into the ink containing portion 1 to trigger the ink falling action.

In the ink refilling method in this embodiment using the gravity, the ink is filled in accordance with the ink absorbing speed of the absorbing material 13 in the ink container, In order to cause the ink falling speed to be responsive to the ink absorbing speed, the ink injection tube 6 and the air vent 14 are closely contacted, and/or the ink injection tube is press-contacted to the absorbing material. The ink is not forced beyond the ink absorbing speed, and therefore, the liability of the ink leakage can be effectively prevented. The ink absorbing speed of the ink absorbing material 13 is influenced by the material, the degree of dryness of the ink absorbing material upon the ink refilling operation. Generally, however, it is not less than 40 sec/cc. Therefore, by properly machining the inside shape or surface of the ink injection tube, the ink flow-out speed may be made not less than 40 sec/cc.

The description will be made as to another type of ink refiller, and another connection type with the ink container.

Figure 2:
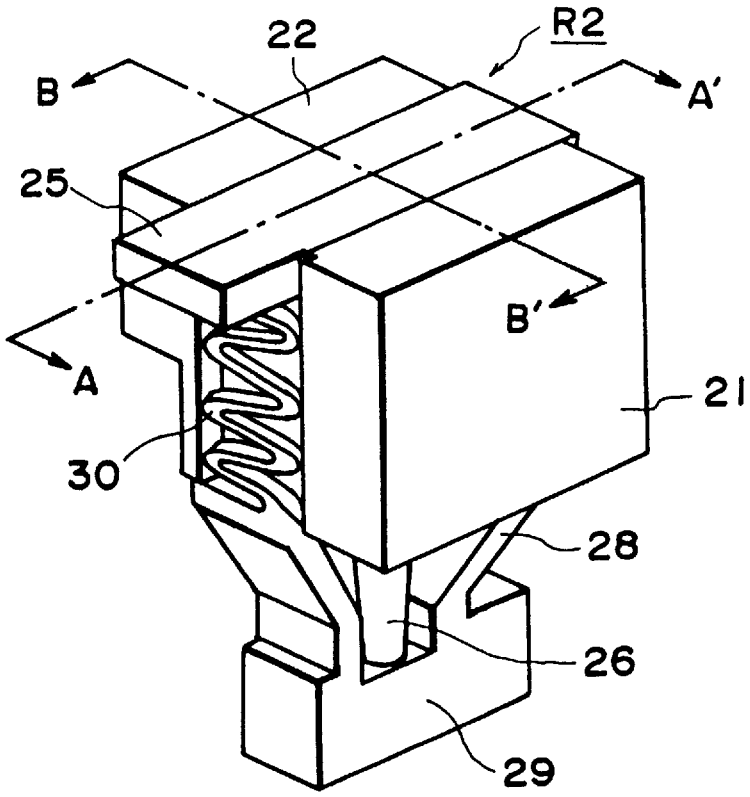
FIG. 2 is a perspective view of an example of an ink refilling container.
Figure 3A:
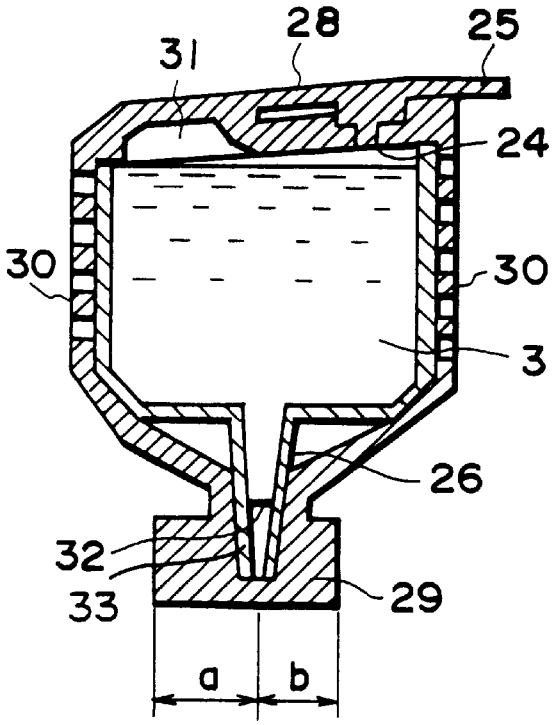
FIG. 3A and FIG. 3B are sectional views of an ink refilling container.
Figure 3B:
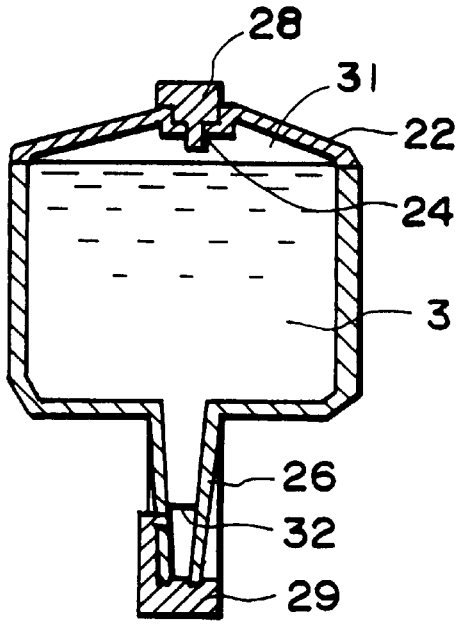
Figure 4:
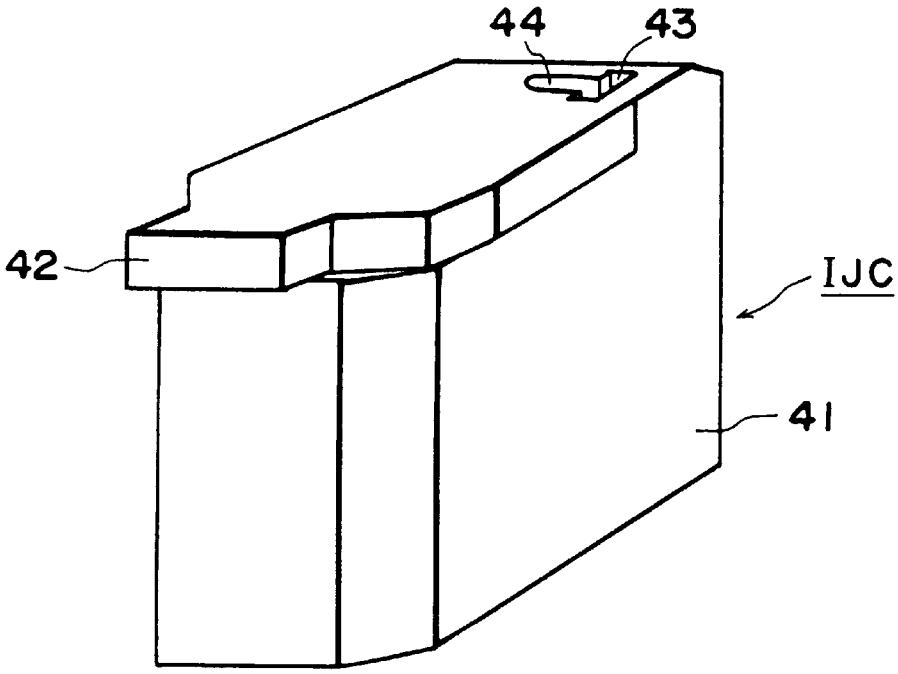
FIG. 4 is a perspective view of an ink cartridge.

FIGS. 2–7 show an ink refilling container and an ink refilling method using the container according to other embodiments of the present invention. In FIG. 2, there is shown an ink refiller in a perspective view, FIG. 3 is a sectional view thereof, FIG. 4 shows an ink jet cartridge having a closable injection port for the ink refilling. FIGS. 5, 6 and 7 show operation steps and relative relationship between the ink refiller and the ink jet cartridge in an ink refilling operation.

FIGS. 2, 3A and 3B show an ink refiller R2. FIG. 3A is a sectional view taken along a line IIIA–IIIA' in FIG. 2, and FIG. 3B is a sectional view taken along a line IIIB–IIIB' of FIG. 2. The ink refiller R2 comprise an ink containing portion 21, a cap band 28, and a covering member 22 for covering the ink containing portion 21. The ink containing portion 21 is closed by the covering member 22, and the injection tube 26 is provided at the opposite side therefrom. The cap band 28 is provided with a hook-like cap (cap) 29, an elastic portion 30, a releasing lever 25, a pressurizing chamber 31 and an air vent 24. The cap 29 and the injection tube are fixed by a lock mechanism 33.

Figures 5A, 5B, 5C:
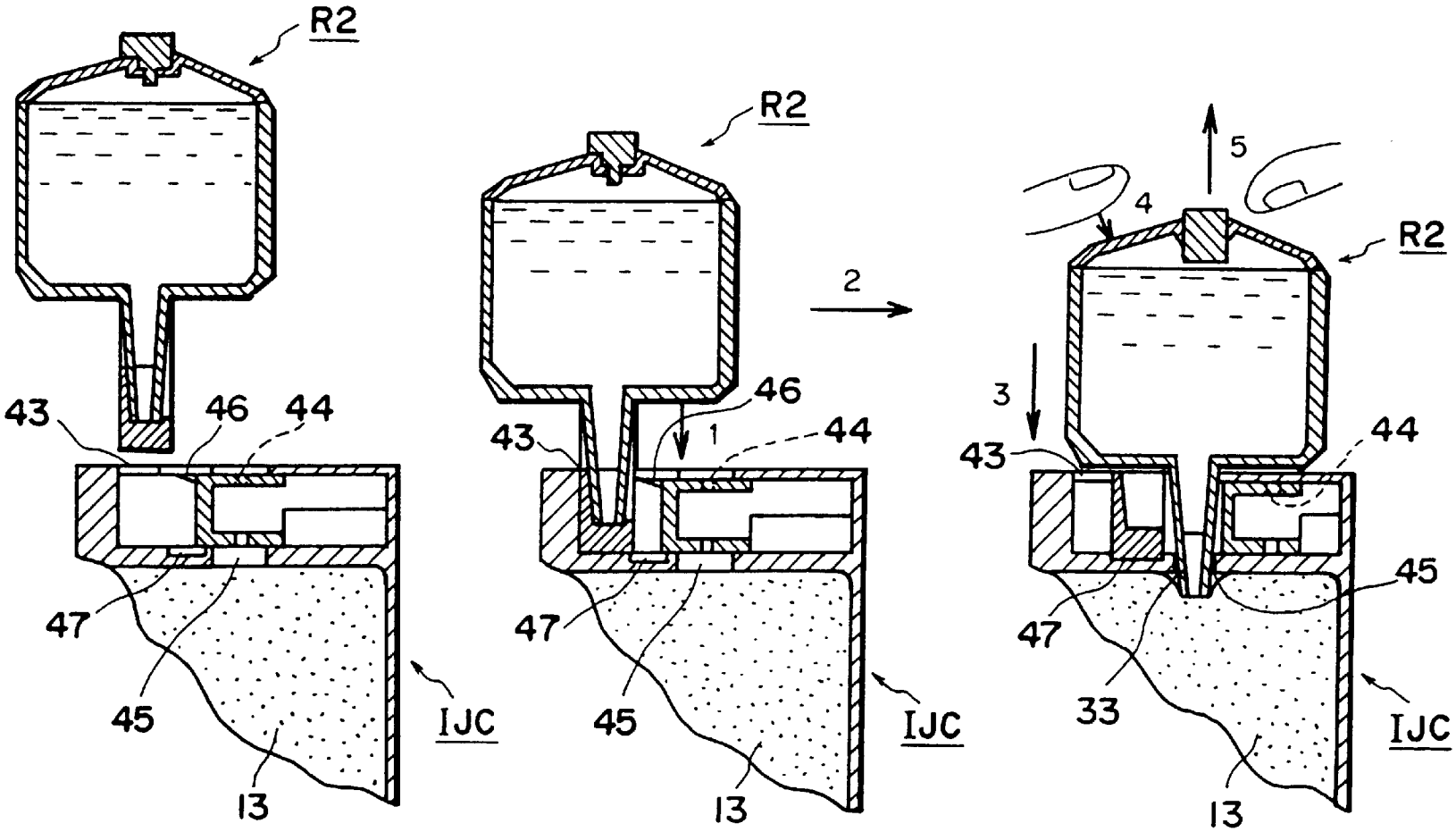
FIGS. 5A, 5B and 5C illustrate ink refilling steps.

FIG. 4 is a perspective view of an ink jet cartridge to be refilled. FIGS. 5A–5C illustrate the mounting operation for mounting the ink refiller R2 to the ink cartridge. FIGS. 6A–6D illustrate the mounting. As shown in FIG. 4, an ink cartridge is provided with an air vent 44. Below a hook hole 23 of the ink cartridge, there are provided a movable communication port 44 (air vent) for introducing air upon printing operation, and an injection port 45. Below it, the ink absorbing material 13 is closely contacted. The movable communication port 44 is fixed by the movable communication port locking mechanism 50 and a movable communication port stopper 48. Adjacent the hole 43 of the communication port 44, there are provided a wedge 46 for removing the cap, a cap stopper A47 and a cap stopper B49.

Figure 6D:
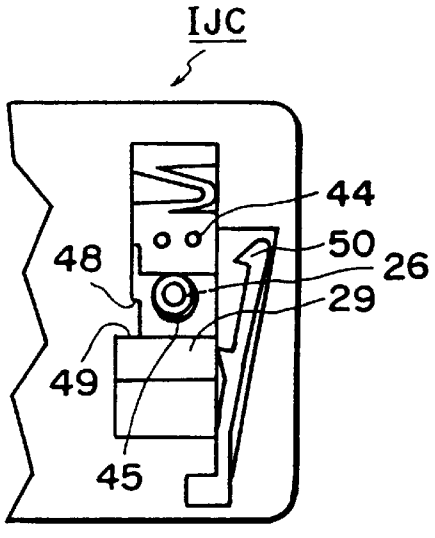
FIGS. 6A, 6B, 6C and 6D illustrate ink refilling steps particularly at the ink injection port.
Figure 6C:
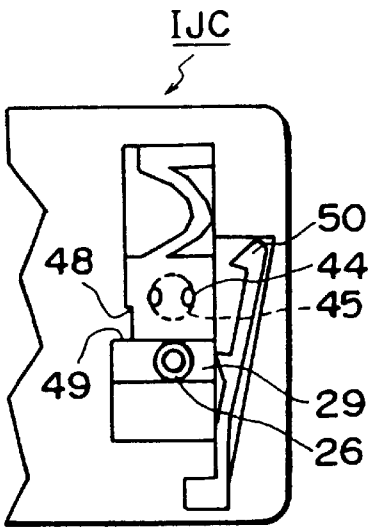
Figure 6B:
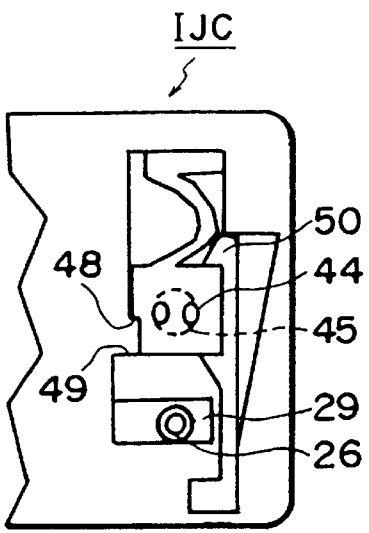
Figure 6A:
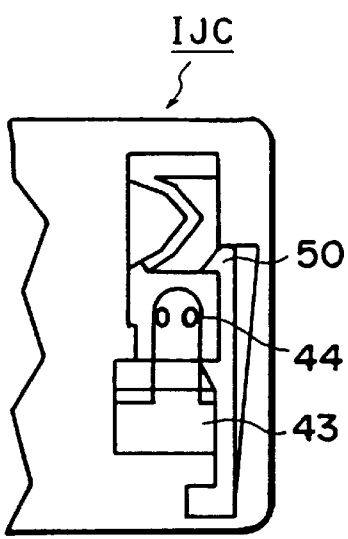

The manipulation steps will be described referring to FIGS. 5A, 5B, 5C, 6B, 6C and 6D. First, as shown in FIG. 5B, the cap 29 of the ink refiller R2 is inserted into a hole 43 in a direction (1). Subsequently, the ink refiller R2 is deviated toward the movable communication port 44, that is, in the direction (2) in FIG. 5B. As shown in FIG. 3A, the distances from the center of the injection tube 26 are different (a, b), and therefore, if it is inserted in the opposite direction, it can not be deviated. With the deviating action, the cap 29 is abutted to the cap stopper B49 while being pushed by the wedge 46 for removing the cap, and as shown in FIG. 6C, it is engaged with the cap stopper A47. At this time, the movable communication port locking mechanism 50 is released by being pushed by the cap 29 As shown in FIG. 6C, the movable communication port 44 becomes movable. With further deviating motion of the ink refiller R2, the cap 29 is away from the injection tube 26, by which the injection tube 26 pushes the communication port 44 so as to reach the end portion of the hole 43, as shown in FIG. 6D. With this state, the injection tube 26 is insertable into the injection port 45. When the refiller R2 is deviated, the elastic portion 30 functions to absorb the stretching of the cap 29 by the cap stopper A47. In this embodiment, simultaneously with the motion of the communication port 44, the cap 29 is away from the injection tube 26, by which the manipulation with short stroke is enabled. Furthermore, the movable communication port 44 is opened immediately before the refilling action by the injection port 26, so that the ink tank is free of the influence of the ambience, and the ink leakage from the ink container is prevented even If it is fallen down.

The movable communication port 44 is moved by the injection tube 26, and is inserted into the injection port 24. Thereafter, while confining the pressurizing chamber 31 of the refiller R2 by one hand, as shown in FIG. 5C, (4), and the releasing lever 25 is released by another hand in a direction (5) in FIG. 5C, by which the air vent 24 is released to permit spontaneous falling of the ink 3 through the injection tube 26. Therefore, there is hardly any possibility of the ink leakage from the ink refiller R2. At this time, the locking cut-away portion 33 of the injection tube 26 is engaged with the injection port 45 to prevent removal of the ink refiller. After this point, the assured refilling action continues with nothing done by the operator.

Since there is air as shown in FIG. 3 at an end of the injection tube 26, a meniscus 32 is formed by surface tension of the ink 3, so that the ink does not fall spontaneously. In this case, when the releasing lever 25 is released, the pressurizing chamber 31 of the ink refiller R2 is pushed strongly, by which the pressurizing chamber 31 is pressurized, so that the meniscus 32 is broken to permit spontaneous falling of the ink. The inside diameter of the injection inlet 45 is made larger than the injection tube 26, by which the air is easily removed from the ink cartridge IJC upon the refilling.

When the ink refilling operation is completed, the operations are carried out in the opposite directions. First, the releasing lever 25 is restored to close the air vent 24. By doing so, the ink does not leak even if some remains therein. Thereafter, the ink refiller R2 is lifted. In this state, it is not removed because of the engagement with the cap 29. Then, the ink refiller R2 is deviated to the key hole 43. At this time, the cap 29 is engaged with the cap stopper A47, and therefore, the injection tube 26 is accommodated in the cap 29.

Simultaneously with this action, the movable communication port 44 is restored to be placed above the injection port 45. The ink refiller R2 is moved further from the hole 43 until the cap 4 is removed. Then, the ink refiller R2 is removed from the ink cartridge IJC. This is the end of the operations. Thus, when the ink refiller R2 is removed, the movable communication port 44 is above the injection port 45, and therefore, the ink does not leak even if the ink jet cartridge falls down, erroneously.

For the purpose of ink refilling, as described hereinbefore, the operator manually connects the ink refilling container and the ink jet cartridge, and effect the refilling operation. In this case, the operator's hands may be contaminated with the ink. In view of this, an adapter may be used, through which the ink refiller container is set to the ink jet cartridge, before the refilling operation is started. Then, the problem of the contamination with the ink can be further reduced.

FIGS. 7A–7C and 8A–8D show an example using the adapter. As shown in these figures, the adapter AD is provided with a guiding portion 102 for receiving ink refilling container R3 and an ink jet cartridge engaging meter 101 formed into substantially the same outer configuration of the ink jet cartridge IJC. The guiding portion 102 is formed at a position faced to an opening for ink reception of the ink cartridge (air vent in this embodiment).

As for the structure for connecting the ink injection tube 6 of the ink refiller R3 and the air vent of the ink jet cartridge IJC, the guiding portion 102 is provided with a rotatable member 109 rotating about a shaft 105 by operation of a lever 107, and the rotatable member 109 is provided with two pins 104 and 105, and an opening 108. By rotating the rotatable member 109 in a direction A in FIG. 7 by manipulating the lever 107, the pin 104 moves the cap of the ink refilling container R3 in the guiding portion 102 to be removed from the ink injection tube The pin 105 functions to remove the cap into the Ink injection tube after the completion of the refilling operation. Simultaneously with removal of the cap of the ink refiller R3, the movable communication port 44 formed at the air vent portion of the ink jet cartridge IJC is moved by the guide 104 to face the air communication port (injection port) toward the outside.

The ink jet cartridge IJC is provided with a movable communication port 44 at the portion of the air vent 45 and a hole 43. The pin 104 of the adapter AD is inserted into the hole 43 when the adapter AD is mounted to the ink cartridge IJC.

Figure 7C:
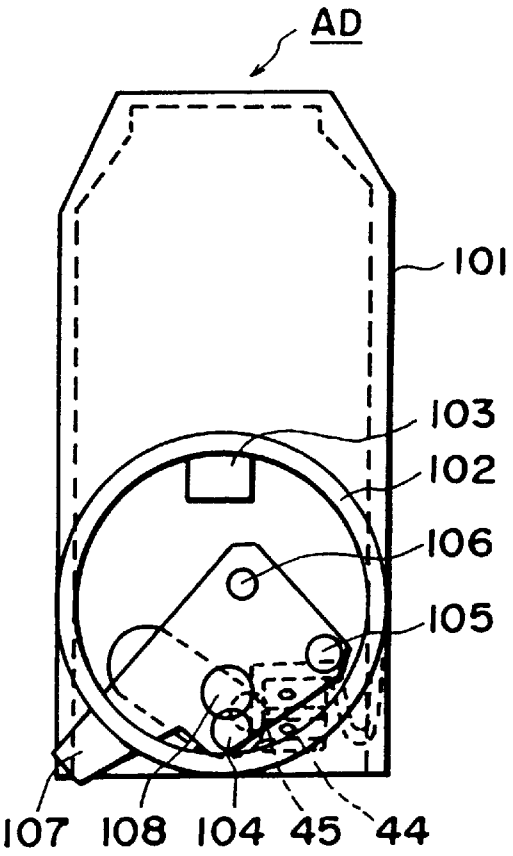
FIGS. 7A, 7B and 7C illustrate ink refilling steps using an adapter, particularly in the operation of a lever of the adapter.
Figure 7B:
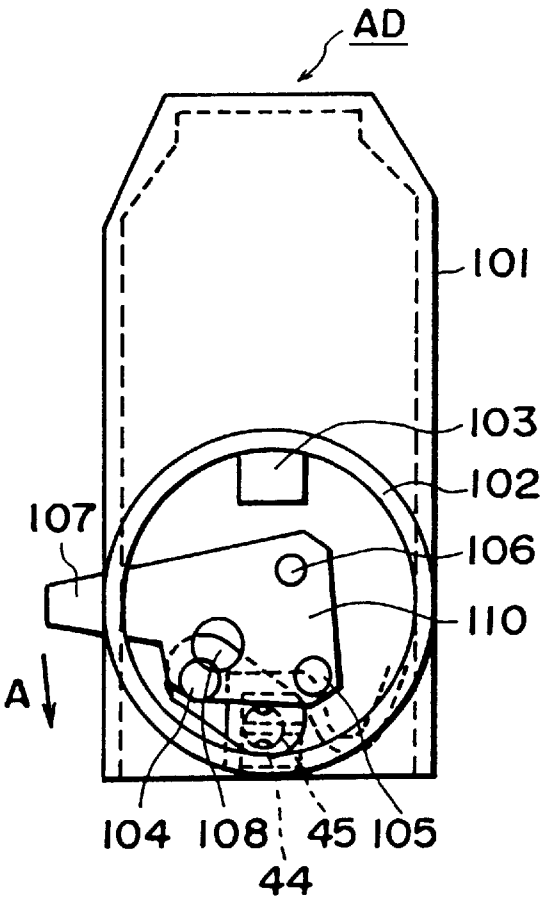
Figure 7A:
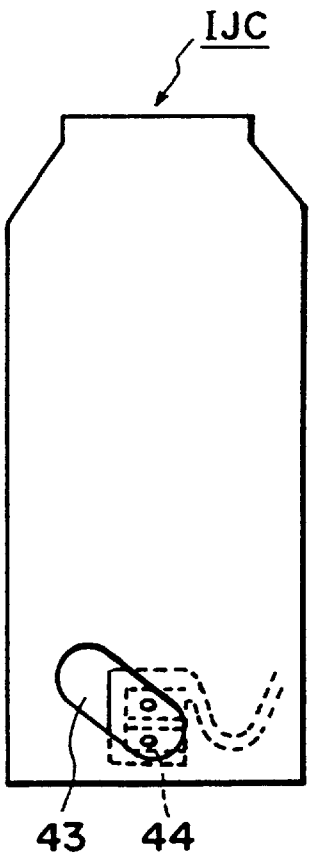
Figure 8A:
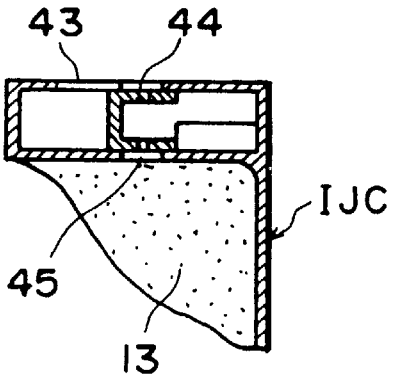
FIGS. 8A, 8B, 8C and 8D illustrate ink refilling steps according to another embodiment of the present invention.
Figure 8C:
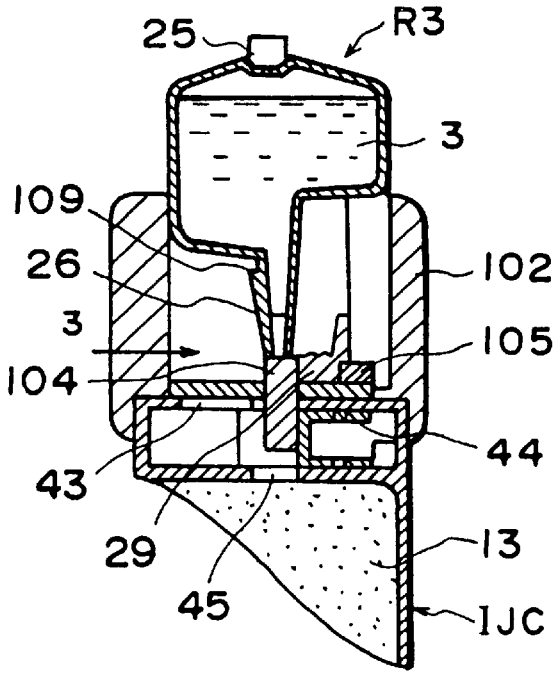
Figure 8B:
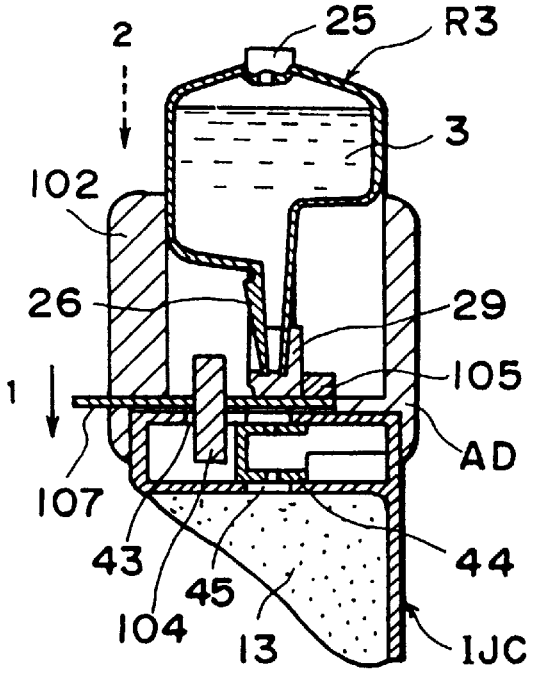
Figure 8D:
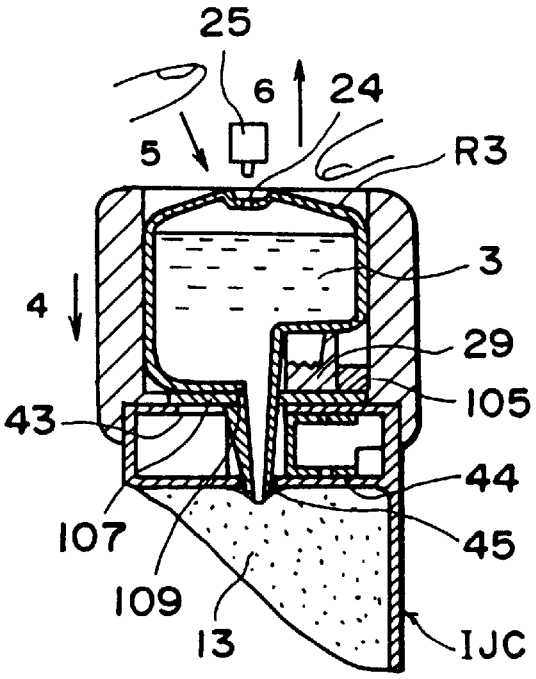

Referring to FIGS. 7B, 7C, 8B, 8C and 8D, the manipulation will be described. As shown in FIG. 7B, the adapter AD is engaged with the ink jet cartridge IJC (direction (1) in FIG. 5B). At this time, projections or a recess is formed in the engaging portion (not shown) to permit engagement with the adapter AD and a particular types of ink cartridge IJC. Subsequently, as shown in FIG. 8B, an ink refilling container R3 is engaged to a rotation preventing mechanism 103 shown in FIG. 7B provided on a guide 102 of the adapter ((2) arrow in FIG. 8B). By the function of the preventing means 103, the direction of the ink refiller R3 is assured. Subsequently, the lever 107 is moved about a shaft 106 in a direction A (FIG. 7B) ((3) in FIG. 8C). At this time, the cap 29 and the movable communication port 44 are pushed by the pin 104 in direction A, and as shown in FIG. 8C, the injection tube 46 and the injection port 45 are opened. At this time, the hole 108 of the lever 107 is brought to the position of the injection port 45. Therefore, as shown in FIG. 7C, the injection tube 46 is insertable into the injection port 45. Subsequently, in order to insert the Injection tube 46 into the injection port 45, it is urged in a direction (4) in FIG. 8D. Further the lever 107 is moved about the shaft 105 in a direction A, and then, a lucking cut-away portion 109 of the injection tube 26 is engaged with a lever 107, as shown in FIG. 8D to prevent removal of the refiller R3. Therefore, the refilling action is assured without operator's manipulation.

Here, when the refiller R3 is inserted, the elastic portion 30 is effective to absorb the tension of the cap in engagement with the pin 104 and the lever 107. In this embodiment, simultaneously with the opening of the movable communication port 44, the cap 29 is disengaged from the injection tube 26. By this, the manipulation through short stroke is enabled. The hole 108 of the lever 107 functions as a stopper to prevent insertion without removal of the cap 29 is prevented. By the lever 107, the movable communication port 44 is opened immediately before the refilling operation, thus preventing ink leakage by the influence of the ambience or by erroneously falling it down. After the injection tube 26 is inserted into the injection port 45 ((4) in FIG. 8D), the pressurizing chamber 31 of the refilling container R3 is confined by one hand, and the releasing lever 25 is released by another hand ((6) of FIG. 8D), by which the air vent 24 is opened to let the ink fall from the injection tube 26 (FIG. 8D). Thus, up to this point, there is hardly any liability of the ink leakage.

Since the injection tube 26 involves air, and therefore, a meniscus 32 is formed by the surface tension of the ink 3, so that the ink does not fall. In such a case, when the releasing lever 25 is released, the pressurizing chamber 31 is pushed by one hand, by which the meniscus 32 is broken to permit spontaneous falling. At this time, the refilling container R3 has already been inserted into the injection port, and therefore, the ink is not liable to leak. The inside diameter of the injection port 45 is made larger than the outer diameter of the injection tube, by which the air is easily removed from the ink jet cartridge IJC during the refilling operation.

After the completion of the ink refilling operation, the above-described operations are carried out in the opposite direction. More particularly, the releasing lever 25 is returned to close the air vent 24, so that the ink leakage is prevented even if the ink remains therein. Thereafter, the lever 107 is returned slightly from the cut-away portion 109, and the refiller R3 is lifted to such an extent that the lever 107 is movable. The lever 107 is returned completely then, and the refiller R3 is lifted. At this time, the cap 7.9 is engaged with the returning pin 105, and therefore, the injection tube is stopped, and simultaneously, the movable communication port 44 is returned to close the injection port 45. The refiller container R3 is removed from the adapter AD. Finally, the adapter AD is removed. When the refiller R3 is removed in this manner, the movable communication port 44 is already closed, and therefore, the ink dues not leak even if it falls down erroneously.

It is preferable that the adapter AD and the ink refiller R3 are on sale together with the ink jet cartridge IJC, for the user's convenience. The service life of the recording head of the ink jet cartridge IJC is sufficiently longer as compared with the quantity of the ink contained in the ink container. However, the ink refilling operation can not be repeated a great number of times, since then the recording head would be broken with the result of improper printing.

Figure 9A:
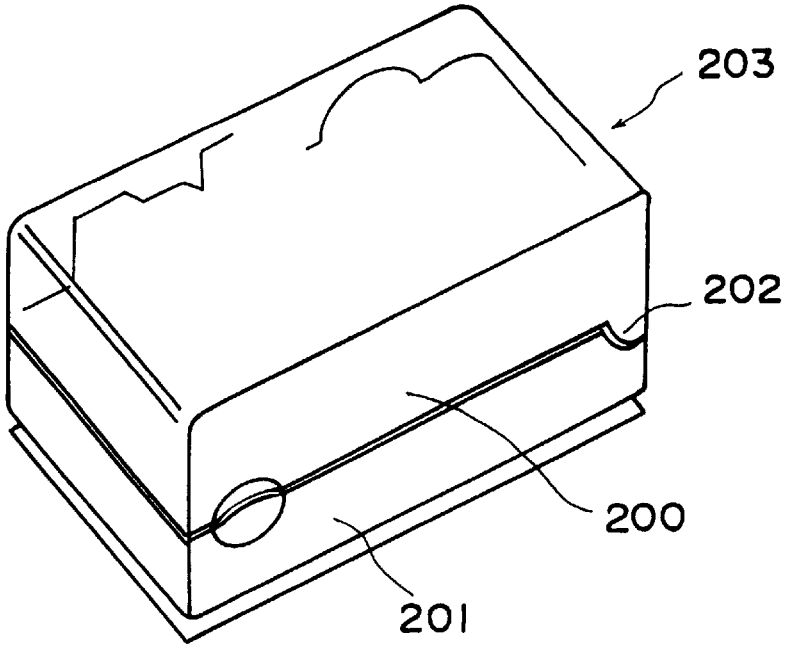
FIGS. 9A and 9B are perspective views of a casing for the ink cartridge, an adapter and an ink refilling container.
Figure 9B:
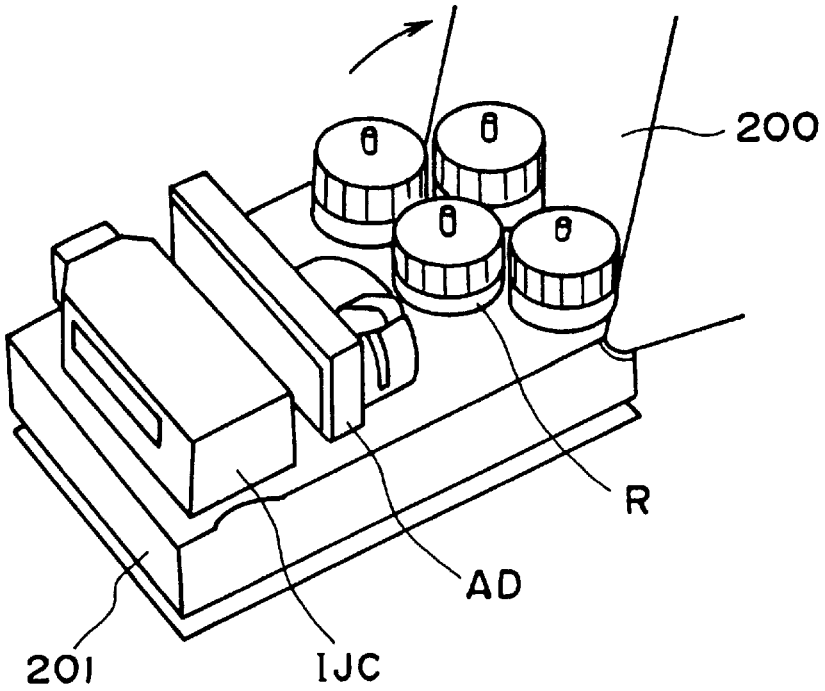

Therefore, a set of ink packages corresponding to the service life of the recording head can be on sale in the same casing, by which the operator is notified of the limit of the refilling for an ink jet cartridge. By doing so, the user will exchange ink jet cartridge IJC after all the ink in the casing is used up. Thus, the recording operation is assured within the service life of the recording head, and the recording head can be efficiently used by the refilling. Referring to FIGS. 9A and 9B, such an embodiment is shown. The casing 203 comprises a top casing 200 and a bottom casing 201 connected with each other by a hinge 202, so that it is openable. The lower casing 201 contains one ink jet cartridge IJC, one adapter AD, and four ink refillers. Thus, the ink cartridge can be used 5 times, including the ink already contained in the ink cartridge.

Figure 10A:
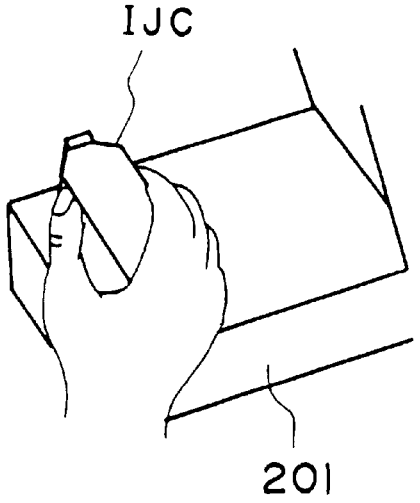
FIGS. 10A, 10B, 10C, and 10D illustrate refilling of the ink container.
Figure 10B:
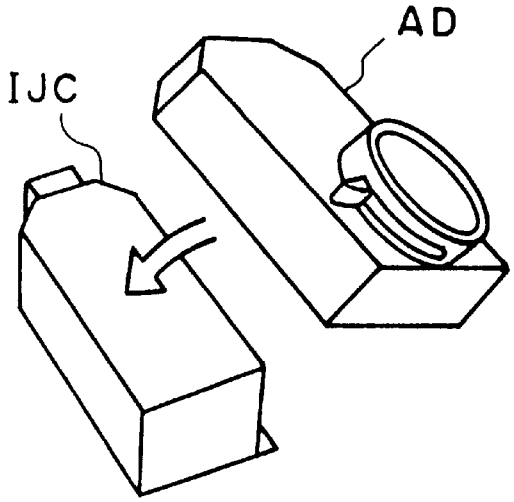
Figure 10C:
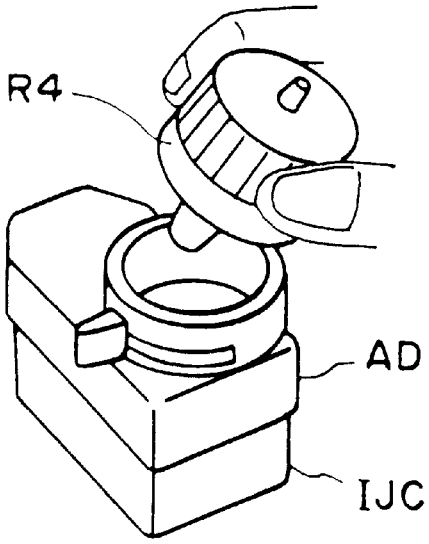
Figure 10D:
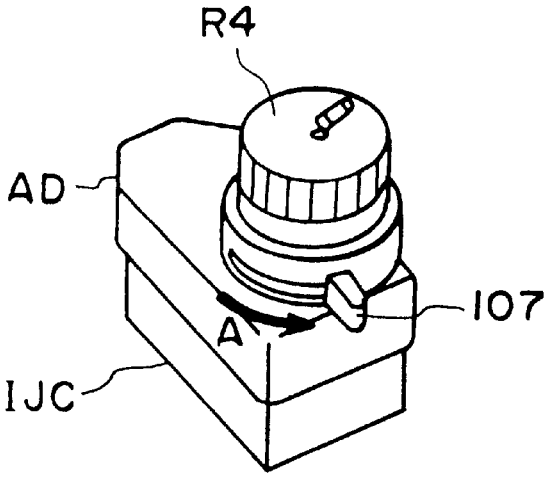

When the refilling of the ink for the ink jet cartridge IJC is required, the ink jet cartridge IJC is fed at a predetermined position in the bottom case 201, as shown in FIG. 10A. In 10A, the refiller R4 and adapter AD are omitted for the sake of simplicity. As shown in FIG. 10B, the adapter AD is set to the ink jet cartridge IJC, and subsequently, as shown in FIG. 10C, the refiller R4 is set to the adapter AD. As in the foregoing embodiment, the lever 107 is moved to insert the refiller R4 into the ink jet cartridge IJC. Then, an air vent 204 is broken as shown in FIG. 10D at a top of the refiller R4. By this, the ink in the ink container is let to fall as in the foregoing embodiment.

According to this embodiment, the air vent 204 is easily broken, and therefore, the refilling container R4 can be produced at very low cost. In addition, the operation is possible on the bottom case 201 of the container, and therefore, the deposition of the ink to the neighborhood can be avoided. If an ink absorbing material sheet is placed below the bottom case 201, the contamination with the ink is not a concern. In addition, the nozzle of the ink cartridge is not damaged. Since the ink refilling container R4 is contained between the bottom case 201 and the top case 200, and therefore, the evaporation of the ink from the refilling container R4 can be prevented. In this embodiment, the adapter AD is used, but the adapter AD may not be used, and the refilling manipulation is possible using the casing, similarly.

If all of the ink contained in the ink refilling container or a predetermined quantity of the ink thereof is loaded into the ink cartridge, the ink may overflow if a certain quantity of the ink actually remains. EP0509747A1 or the like discloses that the remaining quantity of the ink in the ink jet recording cartridge is detected by two detecting pins inserted into the ink absorbing material in the ink cartridge. When the remaining quantity of the ink reduces to a predetermined degree so that the resistance between the detecting pins reduces to a predetermined degree, by which it is detected that a predetermined amount of the ink remains.

According to an embodiment of the present invention, the refilling container contains a predetermined quantity of the ink in view of the detected remaining quantity of the ink, and all of the ink in the refilling container is loaded. By doing so, the refilling operation can be repeated without overflow of the ink.

As described in the foregoing, according to the present invention, an addicted ink refilling container is set to the ink cartridge having an addicted movable communication port, and therefore, the ink can be easily reloaded into the used ink cartridge without color mixture and with small time period requiring the user's attention. Since the injection port is a movable communication port, the ink evaporation through the injection port can be minimized. In addition, by using it with the assured detection of the ink remaining quantity, the overflow of the ink can be prevented In addition, there is hardly any compressible portion, and therefore, the ink does not leak even it falls. In addition, the reloading can be effected with addicted ink, and therefore, the nozzle or the like is not damaged. Moreover, the ink refilling container and the ink cartridge may have the same parts as in the conventional ones, and therefore, the running cost is low.

While the invention has been described with reference to the structures disclosed herein, it is not confined to the details set forth and this application is intended to cover such modifications or changes as may come within the purposes of the improvements or the scope of the following claims.

What is claimed is:

1. An ink refilling method in which ink is refilled into an ink jet cartridge having a recording head and an ink container having therein an ink absorbing material for absorbing the ink to be supplied to the recording head and an air vent, said method comprising the steps of:

preparing an ink refilling container having an ink containing portion for containing refilling ink and an ink injection tube extending from the ink containing portion;

inserting the ink injection tube into the air vent of the ink container;

press-contacting an end of the ink injection tube against the absorbing material in the ink container;

establishing fluid communication of the ink containing portion of the ink refilling container with ambience so that a meniscus of the ink formed in the injection tube is broken, in response to which the ink refilling action starts, and forming the air vent in a movable communication port and a fixed communication port, and wherein the fixed communication port is in contact with the absorbing material, and the movable communication port is movable between a position covering the fixed communication port and a position exposing it.

2. An ink refilling method according to claim 10, further comprising the step of providing the air vent with a groove for receiving the ink injection tube, and by moving the ink injection tube along the groove, the movable communication port is moved to expose the fixed communication port and the ink injection tube can be inserted into the fixed communication port.

3. An ink refilling method according to claim 2, further comprising the step of using an adapter to effect an ink refilling operation.

4. An ink refilling method for refilling ink into an ink container, said ink container containing an ink absorbing material and having an ink refilling opening, said refilling being carried out through the ink refilling opening, said method comprising the steps of:

preparing an ink refilling container having an inside which is pressurizable and having a conduit for discharging ink by gravity under atmospheric pressure;

inserting the conduit into said refilling opening so as to press and deform the ink absorbing material without insertion into the ink absorbing material;

breaking an ink meniscus in said conduit by pressurizing the inside of said ink refilling container; and refilling the ink into the ink absorbing material through the conduit by gravity and an ink absorbing force of the ink absorbing material.

5. An ink refilling method according to claim 14, wherein in said meniscus breaking step, the pressure inside of said refilling container is used to force the meniscus against the absorbing material.

6. An ink refilling method according to claim 4, including the step of venting air in said ink container via its refilling opening.

7. An ink refilling method according to claim 4, wherein said ink container includes an air vent having a movable communication port and a fixed communication port, and wherein the fixed communication port is in contact with the absorbing material, and the movable communication port is movable between a covering position covering the fixed communication port and an exposing position exposing the fixed communication port, and wherein said inserting step includes the step of moving said movable communication port from the covering position to the exposing position.

8. An ink refilling method according to claim 4, further comprising the step of capping the conduit after said refilling step.

9. An ink refilling apparatus used with a method as defined in claim 4, comprising:

an ink accommodating portion for directly accommodating the ink to be refilled, said accommodating portion being in fluid communication with the ambient upon said step of refilling; and a conduit for discharging the ink from said ink accommodating portion;

wherein a meniscus of ink is formed adjacent an end of said conduit so that the ink does not leak out when said accommodating portion is not in fluid communication with the ambient.

10. An apparatus according to claim 9, wherein said conduit has an inside diameter of 1–3 millimeters.

11. An apparatus according to claim 9, wherein said conduit is capped at the end.

12. Apparatus according to claim 9, wherein said ink accommodating portion has an elastic portion.

13. An apparatus according to claim 9, wherein a cap is provided at the end of said conduit and wherein said conduit is deviated relative to said cap.

14. An apparatus according to claim 9, further comprising an adapter to be mounted in said ink container.

15. An apparatus according to claim 9, wherein said ink accommodating portion is provided with an air vent and a cap therefor.

16. An ink refilling kit used with an ink refilling method according to claim 4, for refilling an ink jet cartridge that includes a recording head and a chamber containing the ink absorbing material and having the refilling opening, said ink refilling kit comprising:

a plurality of ink refilling containers each for refilling the chamber; and a casing for said plurality of ink refilling containers and optionally for said ink jet cartridge; wherein each of said ink refilling containers includes:

an ink accommodating portion for directly accommodating the ink to be refilled, said accommodating portion being in fluid communication with the ambient during a refilling operation; and a conduit in fluid communication with and for discharging the ink from said ink accommodating portion;

wherein a meniscus of the ink is formed adjacent an end of said conduit so that the ink does not leak out when said ink accommodating portion is not in fluid communication with ambience.

17. An ink refilling method according to claim 7, further comprising the step of providing the air vent with a groove for receiving the ink injection tube, and by moving the ink injection tube along the groove, the movable communication port is moved to expose the fixed communication port and the ink injection tube can be inserted into the fixed communication port.

18. An ink refilling method according to claim 4, wherein in said inserting step, the conduit is inserted into said refilling opening so as to press and deform a surface of the ink absorbing material, wherein the surface is a surface adjacent said refilling opening.

19. An ink refilling method for refilling ink into an ink container, said ink container containing an ink absorbing material and having an ink refilling opening, said refilling being carried out through the ink refilling opening, said method comprising the steps of:

preparing an ink refilling container having an inside which is pressurizable and having a conduit for discharging ink by gravity under atmospheric pressure;

inserting the conduit into said refilling opening so as to press and deform the ink absorbing material without insertion into the ink absorbing material;

breaking an ink meniscus in said conduit by pressurizing the inside of said ink refilling container; and refilling the ink into the ink absorbing material through the conduit by gravity.

20. An ink refilling method for refilling ink into an ink container, said ink container containing an ink absorbing material and having an ink refilling opening, said refilling being carried out through the ink refilling opening, said method comprising the steps of:

preparing an ink refilling container having an inside which is pressurizable and having a conduit for discharging ink by gravity under atmospheric pressure;

inserting the conduit into said refilling opening so as to press and deform the ink absorbing material without insertion into the ink absorbing material;

breaking an ink meniscus in said conduit; and refilling the ink into the ink absorbing material through the conduit by gravity.

21. An ink refilling method for refilling ink into an ink container, said ink container containing an ink absorbing material and having an ink refilling opening, said refilling being carried out through the ink refilling opening, sai method comprising the steps of:

preparing an ink refilling container having an inside which is pressurizable and having a conduit for discharging ink by gravity under atmospheric pressure;

inserting the conduit into said refilling opening so as to press and deform the ink absorbing material;

breaking an ink meniscus in said conduit; and refilling the ink into the ink absorbing material through the conduit by gravity when said ink absorbing material is pressed and deformed by said conduit, wherein the ink is supplied from said conduit into said ink absorbing material at such a portion of said ink absorbing material as is thus pressed and deformed.

* * * * *

UNITED STATES PATENT AND TRADEMARK OFFICE

CERTIFICATE OF CORRECTION

PATENT NO. : 6,164,765
DATED : December 26, 2000
INVENTOR(S) : Osamu Sato et al.

It is certified that error appears in the above-identified patent and that said Letters Patent is hereby corrected as shown below:

Column 1,
Line 15, "having" should read -- having an --.
Line 39, "much" should be deleted.
Line 42, "refilled" should read -- refill --.
Line 45, "tors" should read -- tor's --.
Line 48, "bellow" should read -- bellows --.
Line 53, "metal," should read -- metal --; and "has" should read -- have --.
Line 59, "Is" should read -- is --.
Line 64, "It" should read -- it --.

Column 2,
Line 61, "14 for" should read -- 14 is provided for --.

Column 3,
Line 2, "brought into" should be deleted.
Line 12, "is" should be deleted.
Line 47, "heads" should read -- head --.
Line 63, "Is" should read -- is --.

Column 4,
Line 22, "is used" should be deleted.
Line 29, "solved" should read -- dissolved --.
Line 67, "comprise" should read -- comprises --.

Column 5,
Line 51, "If" should read -- if --.

Column 6,
Line 30, "effect" should read -- effects --.
Line 54, "Ink" should read -- ink --.

Column 7,
Line 20, "lucking" should read -- locking --.
Line 32, "cap 29 is" should read -- cap 29. --.
Line 33, "prevented." should be deleted.
Line 44, "and therefore," should be deleted.

UNITED STATES PATENT AND TRADEMARK OFFICE

CERTIFICATE OF CORRECTION

PATENT NO. : 6,164,765
DATED : December 26, 2000
INVENTOR(S) : Osamu Sato et al.

It is certified that error appears in the above-identified patent and that said Letters Patent is hereby corrected as shown below:

Column 8,
Line 5, "dues" should read -- does --.
Line 51, "and therefore," should be deleted.
Line 66, "by which" should be deleted.

Column 9,
Line 7, "addicted" should read -- adaptive --.
Line 8, "addicted" should read -- adaptive --.
Line 17, "it" should read -- if it --.
Line 18, "addicted" should read -- added --.

Column 10, claim 5,
Line 11, "claim 14," should read -- claim 4, --.

Signed and Sealed this

Nineteenth Day of March, 2002

*Attest:*

*Attesting Officer*

JAMES E. ROGAN
*Director of the United States Patent and Trademark Office*